United States Patent [19]

Akamatsu

[11] 4,140,961

[45] Feb. 20, 1979

[54] SHUNT CIRCUIT FOR AN INSULATION TYPE CURRENT TRANSFORMER TO ADAPT TO A WIDE-BAND OF FREQUENCY

[75] Inventor: Masahiko Akamatsu, Amagasaki, Japan

[73] Assignee: Mitsubishi Denki Kabushiki Kaisha, Tokyo, Japan

[21] Appl. No.: 808,613

[22] Filed: Jun. 21, 1977

[51] Int. Cl.[2] ..... G05F 3/04

[52] U.S. Cl. ..... 323/6; 323/61; 323/88; 324/126

[58] Field of Search ..... 323/6, 44 R, 60, 61, 323/50, 85, 88, 74; 324/126, 127

[56] References Cited

U.S. PATENT DOCUMENTS

| | | | |
|---|---|---|---|
| 503,589 | 8/1893 | Evershed | 324/126 |
| 1,162,405 | 11/1915 | Schweitzer | 323/50 |
| 3,229,208 | 1/1966 | Parker | 324/126 |

FOREIGN PATENT DOCUMENTS

| | | | |
|---|---|---|---|
| 723760 | 8/1942 | Fed. Rep. of Germany | 324/127 |

*Primary Examiner*—Gerald Goldberg
*Attorney, Agent, or Firm*—Oblon, Fisher, Spivak, McClelland & Maier

[57] ABSTRACT

A current transformer for large currents having an inductive element, such as a large DC current transformer; a universal current transformer or a wide-band high fidelity current transformer, is improved by providing a shunt circuit which comprises a series connection of a first line comprising a first resistive element and a first inductive element and a second line comprising a series connection of a second resistive element, a second inductive element and the current transformer, wherein the first line is connected in parallel with the second line.

6 Claims, 9 Drawing Figures

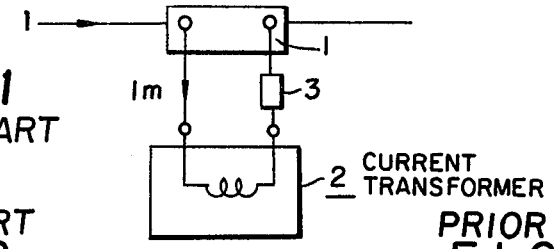
FIG 1
PRIOR ART
PRIOR ART
FIG. 2a
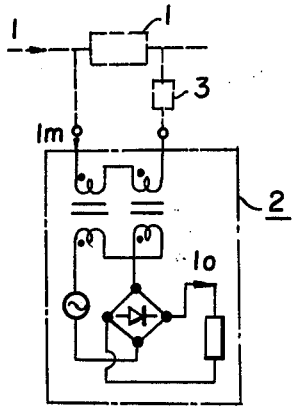
PRIOR ART
FIG. 3a
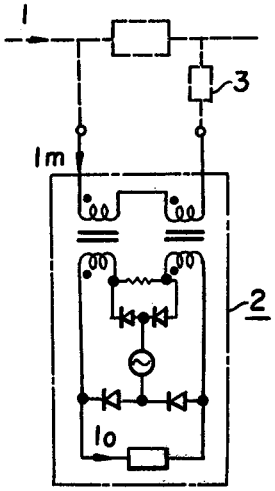
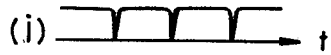
FIG.2b
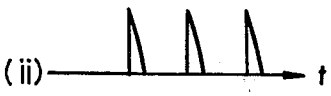
FIG.3b
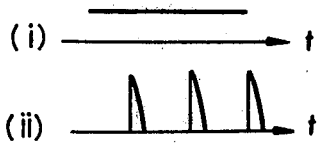
FIG. 4
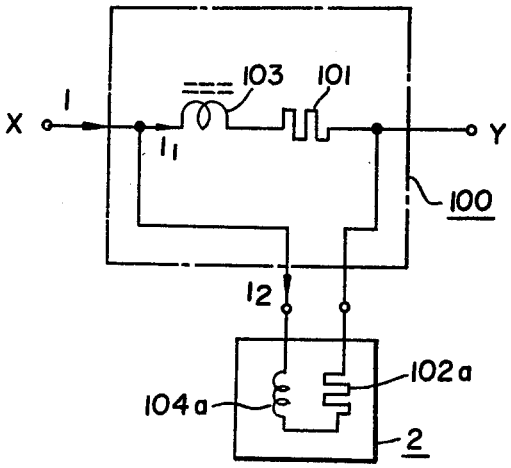

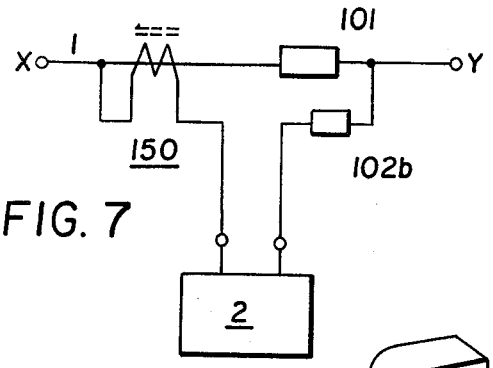
FIG. 7
FIG. 8a
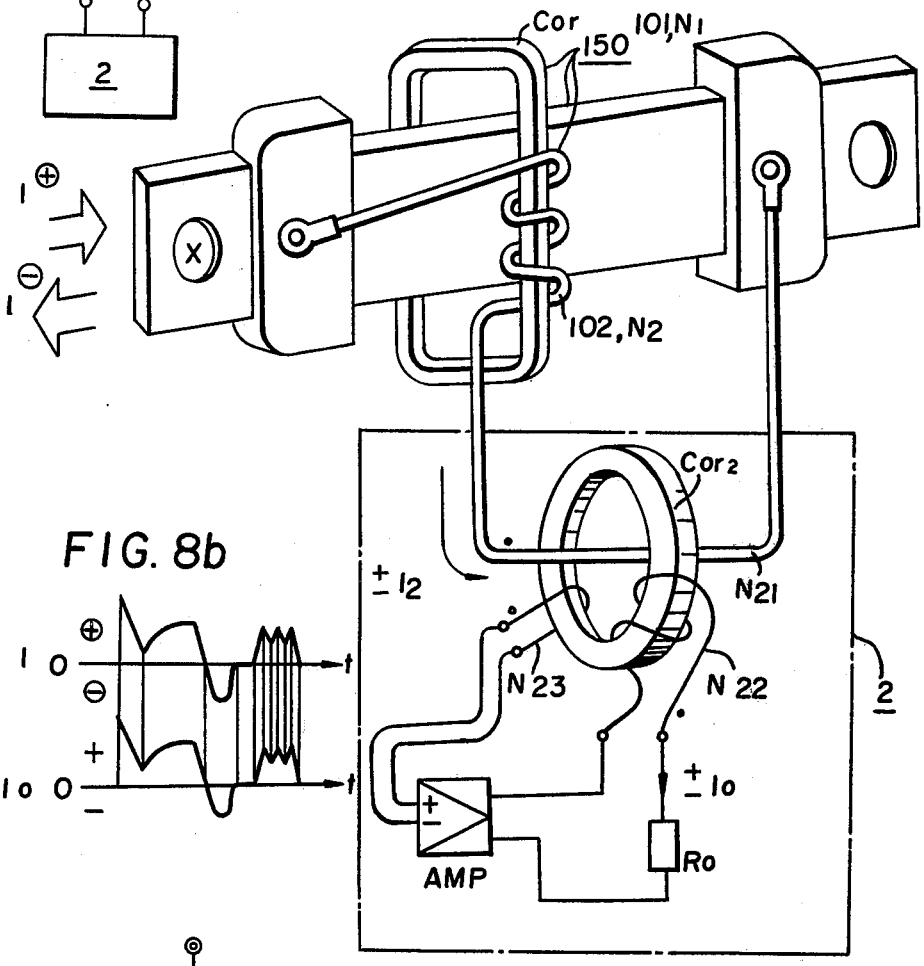
FIG. 8b
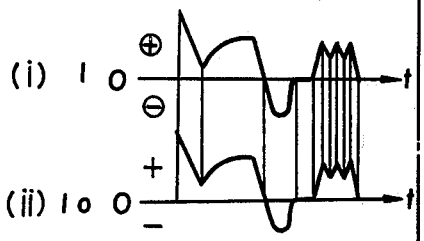
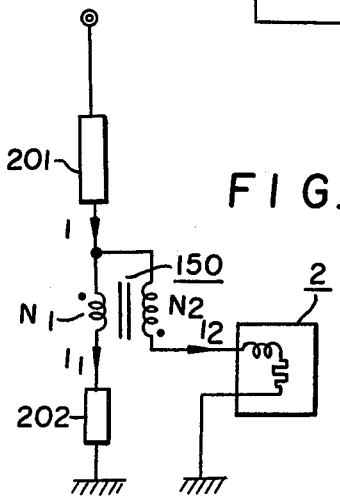
FIG. 9

SHUNT CIRCUIT FOR AN INSULATION TYPE CURRENT TRANSFORMER TO ADAPT TO A WIDE-BAND OF FREQUENCY

BACKGROUND OF THE INVENTION

1. Field of the Invention

The present invention relates to an improvement of a shunt system for an insulation type current transformer. More particularly, it relates to an improvement wherein an input line of the current transformer having inductive input impedance is not negligible.

2. Description of the Prior Art

It has been known to use a resistor as a simple shunt. When a shunt (1) and a current transformer (2) having inductive input impedance are connected through a matching resistor (3) as shown in FIG. 1, the time constant for a closed loop comprising the shunt (1), the resistor (3) and the current transformer (2) is increased to remarkably decrease the response speed of the current transformer. When the resistance of the resistor (3) is increased to overcome the disadvantage, the needed voltage drop of the shunt (1) is increased to disadvantageously increase the power loss and the size of the shunt (1).

In the case of the magnetic coupling insulation type current transformer shown in a rectangle of the chain line in FIG. 2(*a*) and FIG. 3(*a* ) the output $I_O$ being proportional to the flat instantaneous input current I as shown in FIG. 2(*b*)(i) and FIG. 3(*b*)(i) can be obtained by actuating the current transformer under the condition of binding magnetization (the condition of remarkably small effect for variation of the input winding current by the winding electromotive force having high magnetization binding force). FIG. 3(*a*) shows one embodiment of an excellent current transformer having the characteristics being proportional to instantaneous values in all time (ripple free) without any dip in the output current waveform as shown in FIG. 3(*b*)(i).

However, when it is combined with the shunt (1) as shown by the dotted line in FIG. 2(*a*) and FIG. 3(*a*), the circuits are in free magnetizing condition to give the output current waveforms shown in FIG. 2(*b*)(ii) and FIG. 3(*b*)(ii). That is, the instantaneous current proportional characteristic is lost to give a high pulsation. Only the average value of the output current $I_O$ is proportional to the input current I. Moreover, the average value of the output current lags the variation of the input current I whereby the response speed is remarkably deteriorated. In many usages for smoothing the pulsation, the response is further deteriorated. When it is connected in the closed loop control system of a control device, sometimes, it cannot be used.

In order to overcome the difficulty, the main line current I has been directly measured without using the shunt (1). However, it has the serious disadvantage that the magnetic cores and windings of the current transformer should be of large size for high power because of passing the large current. Moreover, the current transformers should be prepared in each specification for each measured current, whereby the standardization in the preparation is difficult. Moreover, in the case of the insulation type current transformer, the response speed tends to be decreased by the current transformer input line inductance. Accordingly, an improvement of the shunt system has been required in the usages that high speed instantaneous response (in pulse current) is required.

SUMMARY OF THE INVENTION

It is an object of the present invention to overcome the disadvantage of the conventional shunt system to improve high response speed.

It is another object of the present invention to improve the binding force for the magnetizing force in the input winding of the magnetic coupling type current transformer, that is to the dependency of the input winding current on the variation of the number of magnetic flux links with the input winding.

The other object of the present invention is to improve a current transformer for large current having an inductive element in a shunt circuit such as a large current DC transformer, a universal current transformer or a wide-band high fidelity current transformer.

The further object of the present invention is to provide a compact and standarized insulation type current transformer for detecting large current which detects the large current by using a DC current transformer for small current or a wide-band high fidelity current transformer.

The foregoing and other objects of the present invention are attained by providing a shunt system for an insulation type current transformer which comprises a shunt circuit having a first line comprising a first resistive element and a first inductive element and a second line comprising a second resistive element and a second inductive element.

BRIEF DESCRIPTION OF THE DRAWINGS

Various objects, features and attendant advantages of the present invention will be fully appreciated as the same becomes better understood from the following detailed description of the present invention when considered in connection with the accompanying drawings, in which;

FIG. 1 to 3 are diagrams of circuits and waveform charts for illustrating the conventional shunt systems; and FIG. 4 to 9 are circuit diagrams for illustrating embodiments of the shunt system of the present invention.

Figure 5A:
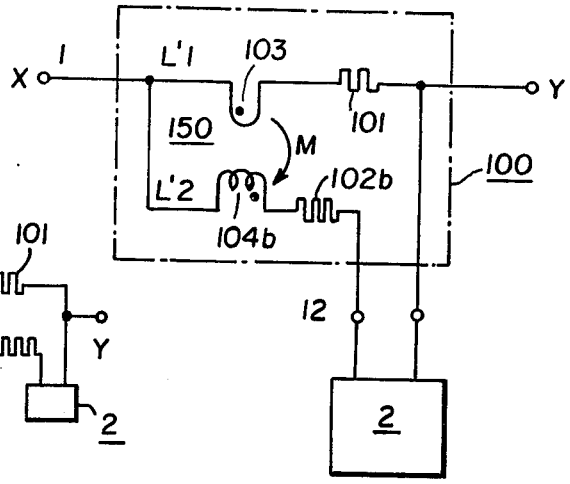

DETAILED DESCRIPTION OF THE PREFERRED EMBODIMENTS:

Referring to the drawings, wherein like reference numerals designate identical or corresponding parts throughout the several views, the embodiments of the present invention will be illustrated.

FIG. 4 is a connection diagram of one embodiment of the present invention wherein a first resistive element (101) and a first inductive element (103) are connected in the first line, and the input winding for the current transformer (2) is connected in the second line and represented by an equivalent inductance and an equivalent resistance a second inductive element (104*a*) and a second resistive element (102*a*).

The first inductive element is preferably selected by the following equation so as to match the inductance of the current transformer input winding.

$$(R_1/R_2) = (L_1/L_2) \quad (1)$$

wherein $R_1$ : resistance in the first line; $R_2$ : resistance in the second line (the current transformer input winding line); $L_1$ : inductance in the first line and $L_2$ : inductance in the second line (the current transformer input winding).

The magnetic flux interlinking numbers $\phi_1$, $\phi_2$ of the inductive elements (103), (104) under the normal shunt currents $I_1$, $I_2$ can be defined as follows.

$$L_1 = \phi_1/I_1$$

$$L_2 = \phi_2/I_2 \quad (2)$$

When the inductance $L_2$ is non-linear (ferromagnetic core), in the main current I, it is preferable to give the equation:

$$\phi_1(I_1) = \phi_2(I_2) \quad (3)$$

That is, it is preferable to provide the inductive element (103) for the magnetic flux interlinking number in the first line which is the same with the magnetic flux interlinking number resulting in the input winding of the current transformer (2) (when the origin is the point at zero of the main current I, the variation under consideration of zero of the magnetic flux interlinking number at I =0 ).

Thus, the magnetic flux electromotive force in the current transformer input winding is counter-balanced with the magnetic flux electromotive force in the first line whereby the transient shunt ratio is matched to the normal shunt ratio whereby the instantaneous proportional relationship between the main current I and the current $I_2$ in the current transformer input winding is always attained.

Figure 5B:
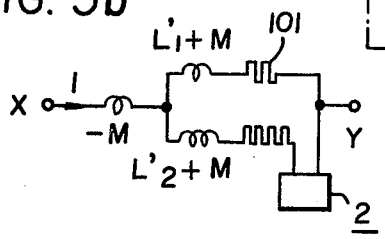

FIG. 5(*a*) is a connection diagram of a second embodiment of the present invention, which comprises an additional inductive element (104*b*) in the second line which is magnetically coupled with the inductive element (103) in the first line. The additional matching resistive element (102*b*) attains the control of resistive ratio and compensations of temperature and transient temperature. For example, when the resistive element (101) is an internal resistance of the induction coil (103) and the induction coil (104*b*) has an internal resistance and is thermally equivalent to the induction coil (103) (one body structure having high thermal conductivity), the temperature compensation of difference caused by variation of the internal resistance of the current transformer (2) is performed by the resistive element (102*b*) for temperature compensation. When the same conductive material is used for the input line of the current transformer (2) to match the ratio of the current density to thermal resistance (heat radiation coefficient), the resistance of the induction coil (104*b*) itself is the resistive element (102*b*) for compensation. When a resistive element having fine temperature coefficient is used as the resistive element (101) in the first line, it is preferable to connect a matching resistive element (102*b*) made of the corresponding resistive material or a matching resistive element (102*b*) corresponding to the difference in the temperature coefficient of the internal resistance of the current transformer (2).

The coupling of the first line induction coil (103) with the second line induction coil (104*b*) imparts the following effects together with the thermal uniformity caused by near arrangement or one body formation and the effect for compensation of resistance temperature variation.

The equivalent circuit is shown in FIG. 5(*b*) when the reference M designates mutual inductance, and $L'_1$ and $L'_2$ designate respectively self-inductances and the dot designates coupling polarity in FIG. 5(*a*). That is, the first line inductance is given as $L'_1 + M$ in equivalent; and the second line additional inductance is given as $L'_2 + M$ in equivalent, whereby the shunt operation with high inductances is attained to improve the transient shunt effect (to decrease the ratio of the internal inductances of the current transformer). In other word, it can be attained by using a small size induction coil device.

The shunt line inductance (parallel composite value) is counter-balanced with the mutual inductance M between the main current terminals X-Y, whereby the degree of effect of the main line inductance caused by connecting the shunt can be decreased. That is, the effect and interference to the phenomenon of the main line are small.

Figure 6A:
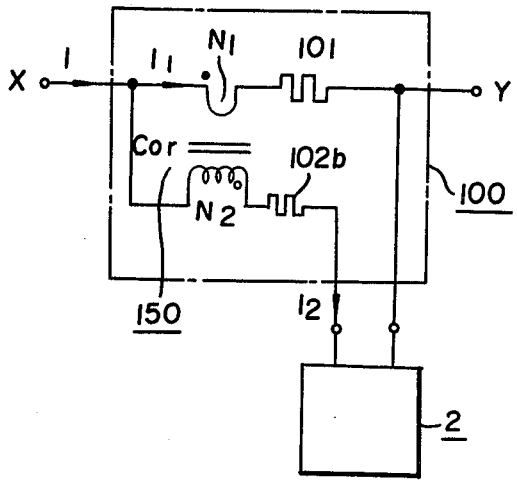
Figure 6B:
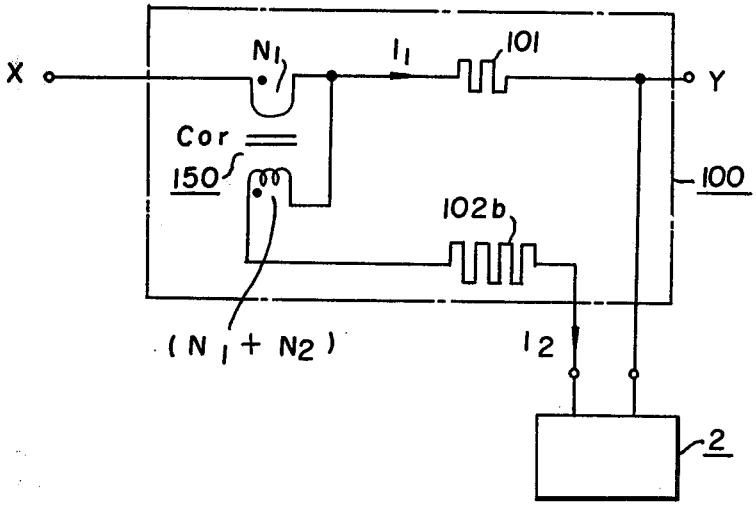

FIG. 6 (*a*) is a circuit diagram of a third embodiment which comprises a magnetic coupling device (150) having a core Cor.

The turn ratio of the first line turn number $N_1$ to the second line turn number $N_2$ is the same as the shunt ratio.

$$(R_1/R_2) = (N_1/N_2) \quad (4)$$

In the embodiment, when the magnetic core exciting current is neglected and this maximum magnetic flux interlinking number $$\psi_{150}^{max} = (N_1 + N_2)\phi_{cor(Bm)}^{max} \quad (5)$$

under the magnetic core maximum magnetic flux density Bm on the series turn numbers $(N_1 + N_2)$ is larger than the maximum magnetic flux interlinking number $$\psi_2^{max}$$

in the input line of the current transformer (2), the core is not saturated in the case of $$\psi_{150}^{max} \geqq \psi_2^{max} \quad (6)$$

and the shunt ratio of the equation (4) can be given in all of the instantaneous moments. The DC component is counter-balanced in the condition of the equation (4). Accordingly, the transient shunt ratio is given by the ratio of turn numbers $N_1/N_2$, and can be equal to the normal shunt ratio $R_1/R_2$, whereby the current transformer input current $I_2$ being proportional to the main current I (instantaneously) can be always obtained in both of normal and transient conditions. The problems of the delay of the response speed and the effect of variation of internal magnetic flux interlinking number of the current transformer (magnetization binding force) can be completely overcome.

Even though the internal AC electromotive force is given in the current transformer (2), the AC electromotive force is absorbed by the windings $(N_1 + N_2)$ of the magnetic coupling device (150). The interference loop current is kless than the exciting current of the core Cor during the time. Accordingly, even though the DC current transformer is connected as shown in FIG. 2(*a*) and FIG. 3(*a*), the condition for the binding magnetization is maintained to completely overcome the trouble of the response speed and the output current waveform.

In FIG. 6(*b*), one terminal of the secondary winding is connected to the contact between the primary winding $N_1$ and the resistive shunt (101) and the secondary winding having turn number corresponding to $N_1 + N_2$ to in FIG. 6(*a* ) to modify the embodiment of FIG.

6(*a*) in equivalent. The winding $N_1$ in FIG. 6(*a*) is also used as a part of the secondary winding. Accordingly, the equivalent is clearly understood.

FIG. 7 is a circuit diagram of a fourth embodiment having the coupling inductive element (150) shown in FIG. 6(*a*), (*b*).

FIG. 8(*a*) is a schematic view of a fifth embodiment of the present invention wherein the resistive shunt (101) inserted through the magnetic core Cor is the primary winding $N_1$ of the magnetic coupling device (150). The resistive wire (102) is wound around the magnetic core Cor connected to one end of the resistive shunt (101) and is passed through the magnetic core Cor 2 of the current transformer and is connected to the other end of the resistive shunt (101). The resistive wire (102) is the secondary winding $N_2$ of the magnetic coupling device (105) and is the input winding $N_{21}$ of the current transformer (2). The current transformer (2) has the secondary winding $N_{22}$ and is connected to the output of the amplifier (AMP) (switching mode exciting means) with a load resistance $R_O$.

The direction of magnetic flux variation is reversed at each time the magnetic flux of the magnetic core Cor 2 reaches to the predetermined level by the exciting means AMP whereby it is reciprocately changed between the first predetermined level $+\phi$ L and the second predetermined level $-\phi$L. Accordingly, the direction winding $N_{23}$ is provided to input it to the exciting means AMP to attain the magnetic flux responsive control.

The predetermined magnetic flux levels $+\phi$L and $-\phi$L are the core saturated magnetic fluxes $+\phi$S, $-\phi$S or less. For example, the voltage of the secondary winding $N_{23}$ reduces each time the magnetic core Cor 2 reaches near saturation, whereby the excitation voltage polarity of the exciting means AMP is reversed. That is, the circuit AMP $N_{22}$-cor 2-$N_{23}$ has a self-oscillating mechanism. The saturation approach time is only the switching time for reversing the excitation voltage polarity of the exciting means AMP and is short whereby the magnetic core Cor 2 is kept in the unsaturated condition for most of the time (almost all time). The induced voltage of the input winding $N_{21}$ by the excitation is absorbed by the magnetic coupling device (150) and does not cause any interference to the input current $I_2$. The binding magnetomotive force (magnetizing force) ATin $= N_{21}\ I_2$ is caused by the input winding $N_{21}$ applied to the magnetic core Cor 2. The current $I_O = N_{21}I_2/N_{22}$ of the secondary winding $N_{22}$ which is counterbalanced with the binding magnetomotive force is passed and is fed by the exciting means AMP. That is, the magnetic flux reciprocal operation between the predetermined magnetic flux levels $+\phi$L, $-\phi$ is maintained even though the current $I_0$ is passed. In the current transformer (2) of FIG. 8(*a*), the proportional relationship between $I_2$ and $I_0$ is maintained for any current (regardless of DC, AC, polarity and frequency) by the reciprocal automatic excitation.

The similar waveform output current $I_0$ shown in FIG. 8(*b*)(ii) corresponding to the main current I shown in FIG. 8(*b*)(i) can be obtained. The instantaneous proportional characteristic is given in the shunt circuit of the embodiment of FIG. 6 and is also given in the current transformer (2) of FIG. 8(*a*).

In accordance with the improvement of the present invention, when the magnetic coupling current transformer is standardized in the levels of 5A or 100A, the current transformer (expensive parts) can be miniaturized in the saturable reactor type current transformer, the magnetic amplifier type current transformer and the magnetic moduator type current transformer of FIGS. 2 and 3 and the new type current transformer (prior invention).

In accordance with the shunt method of the present invention, a simple resistive shunt can be used for the large current line without substantially deteriorating the characteristics.

The magnetic core C or for the magnetic coupling device can be smaller than the small magnetic core Cor 2 of the current transformer (2) or similar to it. For example, when the first line current is 1000A and the shunt second line current is 100A ($N_{21}$ = 1T insertion), the turns numbers of the magnetic coupling device (150) are respectively $N_1$ = 1T (insertion) and $N_2$ = 9T. When the second line current is 5A($N_{21}$ = 20T), the turn numbers of the magnetic coupling device (150) are respectively $N_1$ = 1T, and $N_2$ = 199T. The former is preferable in the case that the core Cor 2 of the current transformer (2) is arranged near the shunt (101). The latter is preferable in the case that the current transformer (2) is disposed in different place.

Thus, the ratio of the total turn numbers $N_1 + N_2$ of the mangetic coupling device (150) to the turn number $N_{21}$ of the transformer is $$(N_1 + N_2)/N_{21} = 10.$$

Accordingly, the magnetic flux of the magnetic core Cor of the magnetic coupling device can be 1/10 of the magnetic flux of the magnetic core Cor 2 of the current transformer (compact size). The ratio $(N_1 + N_2)/N_{21}$ increases depending upon the current passed through the main current line, whereby it is further advantageous from the viewpoint of the sectional area.

Accordingly, the magnetic core Cor of the magnetic coupling device can be made of ferrite and it can be an opening for inserting the bare shunt (101) and the secondary winding $N_2$ (the insulation can be for low voltage). The insulation is given in the side of the small current transformer (2), and the magnetic coupling device can be miniaturized. This is remarkably advantageous than the use of the current transformer for directly passing the main large current and this is easily standardized.

FIG. 9 shows a sixth embodiment of the present invention for the voltage transformer using a shunt wherein the references (201), (202) respectively designate voltage multipliers. In this case, the impedance between the terminals from the side of the current transformer (2) is high whereby the binding mangnetizing condition is attained to improve the output waveform.

The fast response current given by the multipliers (210) (202) is transmitted to the current transformer (2) by the action of the magnetic coupler (150), whereby the response speed is highly improved.

In accordance with the shunt system for passing shunt current to the insulation type current transformer of the present invention, the response speed can be improved by the compensation of the inductance of the current transformer input line (the second line) by connecting the inductive element in the main current line (the first line). Moreover, the inductive element can be minimized and the uniform heating effect is given by connecting the inductive element (magnetically coupled with the inductive element in the first line) in the current transformer input line (the second line).

The impedance of the closed loop of the shunt line can be high to improve the magnetization binding force to the current transformer. The degree of interference of the inductance in the main line by the shunt can be decreased. The inductive element can be selected only by a ratio of turn numbers and can be miniaturized and easily manufactured by using the magnetic coupling inductive element having the magnetic core. The magnetization binding force to the current transformer is remarkably improved.

Accordingly, various improvements can be attained on the measurement detection, transmission and control of various types of currents from DC to AC currents.

What is claimed is:

1. A shunt system for an insulationg type DC current transformer adapting to a wide range of frequency comprising:

a first line inserted in series to a current path to shunt the current thereof, said first line including a first resistive element and a first inductive element connected in series to said first resistive element;

a second line including a second resistive element and a second inductive element, said second line being connected in parallel to said first line to measure the current of the current path, said second line including serially an input winding of the insulation type DC current transformer, said second resistive element including at least the resistance of said input winding, and said second inductive element including at least the inductance of said input winding;

the resistance ratio of the resistance of said first resistive element with respect to the resistance of said second resistive element being chosen for the shunting ratio of the DC component of the current, and the ratio of the inductance of said first inductive element with respect to the inductance of said second inductive element being equated to said resistance ratio for responding to the transient component of said current.

2. The shunt system recited in claim 1 wherein:

the second inductive element has a mutual magnetic coupling characteristic with the first inductive element.

3. The shunt system recited in claim 1 wherein:

the current transformer is a magnetic coupling insulation type current transformer and the impedance of the closed loop of the first line and the second line is increased by the first inductive element and the second inductive element.

4. A shunt system for an insulation type Dc current transformer adapting to a wide range of frequency comprising:

a first line inserted to a current path to shunt the current thereof, said first line including serially a primary winding of a second transformer, said first line having a first resistance including at least the resistance of said primary winding;

a second line being connected in parallel to said first line to measure the current of said current path, said second line including serially a secondary winding of the second transformer and an input winding of the insulation type DC current transformer, said second line having a second resistance including at least the resistance of said secondary winding of the second transformer and the input resistance of the input winding of the insulation type DC current transformer.

5. The shunt system recited in claim 4 wherein:

said secondary winding of the second transformer is magnetically coupled with the primary winding of the second transformer and a magnetic core.

6. The shunt system recited in claim 5 including:

means for applying an auxiliary voltage to said secondary winding of the second transformer.

* * * * *